US006136519A

United States Patent [19]

Hasebe

[11] Patent Number: 6,136,519

[45] Date of Patent: Oct. 24, 2000

[54] SILVER HALIDE COLOR PHOTOGRAPHIC MATERIAL AND METHOD FOR FORMING A COLOR PHOTOGRAPHIC IMAGE

[75] Inventor: Kazunori Hasebe, Minami-ashigara, Japan

[73] Assignee: Fuji Photo Film Co., Ltd., Minami-ashigara, Japan

[21] Appl. No.: 08/063,297

[22] Filed: May 19, 1993

[30] Foreign Application Priority Data

May 25, 1992 [JP] Japan ..... 4-156195

[51] Int. Cl.[7] ..... G03C 1/815; G03C 1/825

[52] U.S. Cl. ..... 430/512; 430/507; 430/523; 430/545; 430/546; 430/628; 430/642; 430/931

[58] Field of Search ..... 430/512, 523, 430/931, 545, 628, 642, 546, 507, 551

[56] References Cited

U.S. PATENT DOCUMENTS

| | | | |
|---|---|---|---|
| 4,692,399 | 9/1987 | Sasaki et al. | 430/512 |
| 4,828,970 | 5/1989 | Kuse et al. | 430/393 |
| 4,865,957 | 9/1989 | Sakai et al. | 430/931 |
| 4,879,204 | 11/1989 | Ishigaki et al. | 430/512 |
| 4,992,358 | 2/1991 | Sasaki et al. | 430/931 |
| 5,200,307 | 4/1993 | Takahashi | 430/507 |
| 5,206,120 | 4/1993 | Hayashi | 430/376 |

FOREIGN PATENT DOCUMENTS

| | | |
|---|---|---|
| WO87-04534 | 7/1987 | European Pat. Off. . |
| 63-264748 | 11/1988 | Japan . |
| 63-286849 | 11/1988 | Japan . |
| 2-77059 | 3/1990 | Japan . |
| 2 090 010 | 6/1982 | United Kingdom . |

OTHER PUBLICATIONS

Database WPI, Derwent Publications Ltd., AN 68–05916 and JP–B–43 010 768.

Patents Abstracts of Japan, vol. 14, No. 101, (P–1012) Feb. 23, 1990.

*Primary Examiner*—Geraldine Letscher

*Attorney, Agent, or Firm*—Burns, Doane, Swecker & Mathis, LLP

[57] ABSTRACT

There is disclosed a silver halide color photographic material and a method for forming a color photographic image by processing said color photographic material with a color developer substantially free from sulfite. Said color photographic material comprises the uppermost non-photosensitive colloid layer of photographic constitutional layers containing a dispersion obtained by emulsifying and dispersing a solution containing at least one ultraviolet-absorbing agent represented by the following formula (I) or (II) and at least one water-insoluble polymer compound, and a gelatin having an isoelectric point of 6.0 or over:

formula (I)

formula (II)

wherein $R_1$, $R_2$, and $R_3$ each represent a hydrogen atom, a halogen atom, a nitro group, a hydroxyl group, an alkyl group, an alkoxy group, an aryl group, an aryloxy group, or an acylamino group; $R_4$ and $R_5$ each represent a hydrogen atom, an alkyl group, an alkoxy group, or an acyl group; X represents —CO— or —COO—, which groups may be substituted; and l, m, and n are each an integer of 1 to 4.

21 Claims, No Drawings

SILVER HALIDE COLOR PHOTOGRAPHIC MATERIAL AND METHOD FOR FORMING A COLOR PHOTOGRAPHIC IMAGE

FIELD OF THE INVENTION

The present invention relates to a silver halide color photographic material and a method for forming a color image using said silver halide color photographic material, and more particularly to a method for forming a color photographic image to provide a color print whose non-image portion is good in whiteness with rapid processing.

BACKGROUND OF THE INVENTION

It is well known that color photography is a process for obtaining dye images by developing a photosensitive material having dye-forming couplers and silver halide emulsions on a support with an aromatic primary amine developing agent, to cause the oxidized product produced from the developing agent to react with the dye-forming couplers (hereinafter called couplers).

The field of color photography has been under strong demand to simplify and to make rapid this color development processing, and many improvements have been made in order to meet this demand; and new, simple, and rapid systems are developed every few years.

To make the process rapid, it is required to shorten the processing time of each of the color-developing step, the bleach-fix step, the washing step, and the drying step. As a method for making the processing rapid, for example, a process is disclosed in International Publication Patent No. WO 87-04534, wherein a high-silver-chloride silver halide color photographic material is rapidly processed with a color developer substantially free from sulfite ions and benzyl alcohol. Although that document discloses how to shorten the developing time, it does not disclose at all how to shorten the time required to wash out, by the development processing, photographic dyes and the like used for increasing the sharpness of an image; and further, since the process does use sulfite ions, which have an effect of decoloring photographic dyes, if the process is applied as it is, the lowering in whiteness of the non-image portion is a problem. Further, although a process for quickening desilvering by lowering the pH of a bleach-fix solution is disclosed in U.S. Pat. No. 4,828,970, this process undesirably acts to delay washing out of photographic dyes, and therefore, lowering of whiteness remains a problem.

The amount of water-soluble dyes to be used is apt to increase in future years with the market's strong demand for improved sharpness.

JP-A ("JP-A" means unexamined published Japanese patent application) No. 286849/1988 discloses a technique for maintaining the optical reflection density at a certain level or over in the case wherein a water-soluble dye is used.

For such an increase in the amount of water-soluble dyes to be used for increasing the sharpness of an image, rapid processing as described above results in an increase of the residual amount of water-soluble dye after the processing, which becomes a serious problem in terms of lowering whiteness.

To quicken the washing out of a water-soluble dye, it is generally effective to reduce the thickness of the film. But if the thickness of the color-forming layer is reduced too much, the desired density of the image cannot be obtained, lowering of the sharpness of the visual image is brought about, and, in spite of the use of the colorant, in some cases, it is likely to occur that the "apparent" sharpness appears lower by contrast. In some cases, an image that was sharp immediately after its printing loses sharpness due to bleeding of the image during storage. If the thickness of an intermediate layer is reduced too much, a problem arises as colors mix due to the processing occurs, which damages the sharpness of color. The so-called protective layer for protecting silver halide emulsions is generally made up of two layers, i.e., an ultraviolet-absorbing layer and a layer covering it. If the ultraviolet-absorbing layer is made thinner, the ultraviolet-absorbing performance is lowered, which lowers the preservability of the image. If the covering layer which is the uppermost layer is made thinner, fogging sensitivity is lowered by pressure, or flaws occur, or a high-boiling organic solvent used as a medium for dispersing an oil-soluble material bleeds out onto the surface of the image, thereby making the surface of the image sticky or causing a powdery material to separate out onto the surface.

Thus, actually obtaining a color image high in image sharpness and high in whiteness of the non-image portion by rapid processing is accompanied by many difficulties, and development of a technique for solving these problems has been awaited.

SUMMARY OF THE INVENTION

The object of the present invention is to provide a silver halide color photographic material from which a color photograph high in whiteness of the non-image portion can be obtained by rapid processing, and a method for forming an image therefrom.

The above and other objects, features, and advantages of the invention will be apparent more fully from the following description.

DETAILED DESCRIPTION OF THE INVENTION

The present inventors have studied the matter in various ways and have found that the above object can be attained by the following silver halide color photographic material and method for forming a color photographic image.

A silver halide color photographic material having photographic constitutional layers comprising a silver halide emulsion layer containing a cyan dye-forming coupler, a silver halide emulsion layer containing a magenta dye-forming coupler, a silver halide emulsion layer containing a yellow dye-forming coupler, and plural non-photosensitive colloid layers, and containing a water-soluble dye, on a reflective support, which comprises, in the uppermost non-photosensitive colloid layer of said photographic constitutional layers, a dispersion obtained by emulsifying and dispersing a solution containing at least one ultraviolet-absorbing agent represented by the following formula (I) or (II) and at least one water-insoluble polymer compound and a gelatin having an isoelectric point of 6.0 or over:

formula (I)

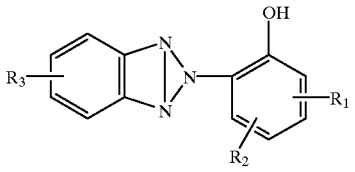

formula (II)

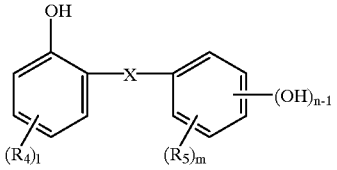

wherein $R_1$, $R_2$, and $R_3$ each represent a hydrogen atom, a halogen atom, a nitro group, a hydroxyl group, an alkyl group, an alkoxy group, an aryl group, an aryloxy group, or an acylamino group; $R_4$ and $R_5$ each represent a hydrogen atom, an alkyl group, an alkoxy group, or an acyl group; X represents —CO— or —COO—, which groups may be substituted; and l, m, and n are each an integer of 1 to 4.

In a preferred embodiment at least one of ultraviolet-absorbing agents represented by formula (I) or (II) is a liquid at normal temperature.

In another embodiment the hydrophilic colloid layer containing at least one ultraviolet-absorbing agent represented by formula (I) or (II) and at least one water-insoluble polymer compound, is substantially free from high-boiling organic solvent.

In even another embodiment the average silver chloride content of the silver halide emulsion contained in at least one emulsion layer is 90 mol % or more.

A preferred method according to the invention comprises processing the color photographic material with a color developer substantially free from sulfite.

Preferably processing is completed within 4 minutes from the start of color development to the completion of washing or stabilizing processing.

The silver halide emulsion for use in the present invention generally comprises silver iodobromide, silver chloride, silver chlorobromide, or silver chloroiodobromide. Preferably use is made of a silver chloride emulsion or silver chiorobromide emulsion substantially free from silver iodide and having an average silver chloride content of 90 mol % or more. Herein the expression "substantially free from silver iodide" means that the silver iodide content is preferably 1 mol % or less, more preferably 0.2 mol % or less.

Although the halogen composition of the emulsion may differ from grain to grain, if an emulsion whose grains have the same halogen composition from grain to grain is used, the properties may be easily made homogeneous among the grains. With respect to the halogen composition distribution in the silver halide emulsion grains, grains that can be suitably selected from, for example, grains having a so-called uniform-type structure, wherein the composition is the same throughout the silver halide grain; grains having a so-called layered-type structure, wherein the composition of the core in the silver halide grain is different from that of the shell(s) surrounding it; and grains having a structure wherein non-layered parts different in composition are formed in the grains or on the surface of the grains (in the case wherein the non-layered parts different in composition are present on the surface of the grains, the parts are joined to the edges or corners or planes of the grains). To obtain a high sensitivity, the latter two are advantageously preferred to the former grains having a uniform-type structure, and are preferable in view of the pressure-resistance properties. If the silver halide grains have such a structure, the boundary between the parts different in halogen composition may be distinct or indistinct, due to the formation of mixed crystals having different compositions, or the boundary may be such that the composition is changed positively continuously.

With respect to the halogen composition of these silver chlorobromide emulsions, a so-called high-silver-chloride emulsion, which is high in silver chloride content, is suitable for rapid processing, and in the present invention the silver chloride content is more preferably 95 mol % or more.

In the high-silver-chloride emulsion, a preferable structure is such that a silver bromide localized phase is present in the form of layers or non-layers in the silver halide grains and/or on the surface of the silver halide grains, as described above. Preferably the silver bromide content of the halogen composition of the above localized phase is at least 10 mol %, more preferably over 20 mol %. The localized phase may be present at inner side of the grains or on the edges, corners, or planes of the surface of the grains, and a preferable example is such that the localized phase is epitaxially grown on the corners of the grains.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion to be used in the present invention (the diameter of a circle equivalent to the projected area of the grain is assumed to be the grain size, and the number average of grain sizes is assumed to be an average grain size) is preferably 0.1 to 2 $\mu$m.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grains in a regular crystal form, such as cubic, tetradecahedral, or octahedral, or grains in an irregular crystal form, such as spherical or tabular, or grains that are a composite of these. Also, a mixture of silver halide grains having various crystal forms can be used. In the present invention, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, are preferably used.

The silver chlorobromide emulsion used in the present invention can be prepared by methods described, for example, by P. Glafkides, *in Chimie et Phisique Photographigue* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion grains for use in the present invention, various polyvalent metal ion dopants can be introduced in the process of the formation or physical ripening of the emulsion grains. Examples of the compounds used include salts of cadmium, zinc, lead, copper, and thallium, and salts or complex salts of elements of Group VIII, such as iron, ruthenium, rhodium, palladium, osmium, iridium, and platinum. In particular, complex salts of elements of Group VIII are preferably used. Although the amounts of these compounds to be added vary over a wide range depending on purpose, preferably the amounts will be $10^{-9}$ to $10^{-2}$ mol per mol of the silver halide.

Generally the silver halide emulsion for use in the present invention is chemically and spectrally sensitized.

As the chemical sensitization, for example, sulfur sensitization, wherein typically an unstable sulfur compound is added; noble metal sensitization, wherein typically gold sensitization is carried out; and reduction sensitization, can be used singly or in combination. As the compound used in the chemical sensitization, those described in JP-A No. 215272/1987, page 18, the right lower column, to page 22, the right upper column, are preferably used.

The spectral sensitization is carried out to make the emulsion layers of the photographic material of the present invention spectral sensitized to desired light wave ranges. In the present invention, it is carried out by adding a spectral sensitizing dye; i.e., a dye that can absorb light in the wavelength range corresponding to the desired spectral sensitivity. As the spectral sensitizing dye to be used herein, those described by F. M. Harmer in *Heterocyclic Compounds—Cyanine Dyes and Related Compounds*, published by John Wiley & Sons (New York, London), 1964, can be used. As specific examples of the compound and the spectral sensitization, those described in the above-mentioned JP-A No. 215272/1987, page 22, the right upper column, to page 38, are preferably used.

To the silver halide emulsion to be used in the present invention, various compounds and their precursors can be added for the purpose of preventing fogging during the process of producing the photographic material, during the storage thereof, or during the photographic processing thereof, or for the purpose of stabilizing the photographic properties. As specific examples of the compounds, those described in the above-mentioned JP-A No. 215272/1987, pages 39 to 72, are preferably used.

The emulsion to be used in the present invention may be a so-called surface-latent-image-type emulsion, wherein a latent image will be formed mainly on the grains surface, or a so-called internal-latent-image-type emulsion, wherein a latent image will be formed mainly in the grains.

The compounds for use in the present invention represented by formulae (I) and (II) will be described in more detail.

In formula (I), $R_1$, $R_2$, and $R_3$ each represent a hydrogen atom, a halogen atom (e.g., fluorine atom and chlorine atom), a nitro group, a hydroxyl group, an alkyl group (including straight-chain, branched-chain, cyclic, saturated, unsaturated, substituted, or unsubstituted alkyl groups having carbon atoms of 1 to 30, preferably 1 to 20; e.g., methyl, ethyl isopropyl, cyclopropyl, trifluoromethyl, and cyclopentyl), an alkoxy group (having carbon atoms of 1 to 30, preferably 1 to 20; e.g., methoxy and dodecyloxy), an aryl group (including substituted or unsubstituted aromatic groups having carbon atoms of 6 or more, preferably 6 to 10; e.g., phenyl and naphthyl), an aryloxy group (including those having carbon atoms of 6 to 20, preferably 6 to 10; e.g., phenoxy and 4-chlorophenoxy), or an acylamino group (including those having carbon atoms of 1 to 30, preferably 2 to 20; e.g., acetylamino and benzoylamino).

In formula (II), $R_4$ and $R_5$ each represent a hydrogen atom, an alkyl group (including straight-chain, branched-chain, cyclic, saturated, unsaturated, substituted, or unsubstituted alkyl groups having 1 to 30 carbon atoms, preferably 1 to 20; e.g., methyl, ethyl, isopropyl, cyclopropyl, trifluoromethyl, and cyclopentyl), an alkoxy group (including those having 1 to 30 carbon atoms preferably 1 to 20; e.g., methoxy and dodecyloxy), or an acyl group (including those having 1 to 30 atoms, preferably 2 to 20; e.g., acetyl and benzoyl).

Among compounds represented by formula (I) and (II), a compound represented by formula (I) is preferable.

Details of the compound used in the present invention represented by formula (I) are described, for example, in JP-A Nos. 221844/1983, 46646/1984, and 109055/1984, JP-B ("JP-B" means examined Japanese patent publication) Nos. 10466/1961, 26187/1967, 5496/1973, and 41572/1973, and U.S. Pat. Nos. 3,754,919 and 4,220,711.

Those that are liquids at normal temperature (25° C.) are described, for example, in JP-B Nos. 36984/1980 and 12587/1980 and JP-A No. 214152/1983.

Details of the compound represented by formula (II) are described, for example, in JP-B Nos. 30493/1973 and 31255/1973.

Specific examples of the ultraviolet-absorbing agent used in the present invention are shown in the following tables, but the present invention is not restricted to them.

Exemplified compounds represented by formula (I)

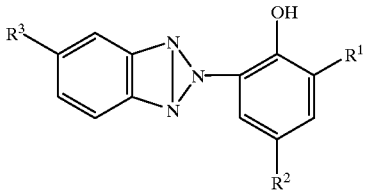

| UV No. | $R_3$ | $R_1$ | $R_2$ |
|---|---|---|---|
| UV-1 | H | H | —$C_4H_9$(t) |
| UV-2 | H | H | —$C_{12}H_{25}$(n) |
| UV-3 | H | H | —$CH_2CH_2COOC_8H_{17}$ |
| UV-4 | Cl | H | —$C_5H_{11}$(t) |
| UV-5 | Cl | H | —$CH_2CH_2COOC_8H_{17}$ |
| UV-6 | H | —$C_4H_9$(sec) | —$C_4H_9$(t) |
| UV-7 | H | —$C_5H_{11}$(t) | —$C_5H_{11}$(t) |
| UV-8 | H | —$C_4H_9$(t) | —$CH_2CH_2COOC_8H_{17}$ |
| UV-9 | H | —$CH_3$ | —$C_4H_9$(t) |
| UV-10 | Cl | —$C_4H_9$(t) | —$C_4H_9$(t) |
| UV-11 | Cl | —$C_4H_9$(sec) | —$C_4H_9$(t) |
| UV-12 | Cl | —$C_4H_9$(t) | —$CH_2CH_2COOC_8H_{17}$ |
| UV-13 | —$OCH_3$ | —$C_4H_9$(sec) | —$C_4H_9$(t) |
| UV-14 | —$C_4H_9$(sec) | —$C_4H_9$(t) | —$CH_2CH_2COOC_8H_{17}$ |
| UV-15 | —$C_6H_5$ | —$C_5H_{11}$(t) | —$C_5H_{11}$(t) |

Exemplified compounds represented by formula (II)

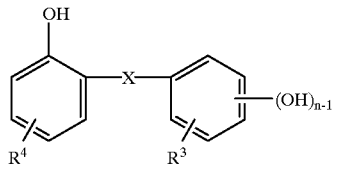

| UV No. | X | $R_4$ | $R_5$ | n Position of —(OH) |
|---|---|---|---|---|
| UV-16 | —CO— | 5-$OC_4H_9$ | H | 1 |
| UV-17 | " | 5-$OC_8H_{17}$ | H | 1 |
| UV-18 | " | 5-$OC_{16}H_{33}$ | H | 1 |
| UV-19 | | 5-$OC_{18}H_{37}$ | H | 1 |
| UV-20 | " | 4-$OC_4H_9$ | 4'-$OCH_3$ | 3 2'-, 5'- |
| UV-21 | " | 5-$COCH_3$ | 3'-$C_8H_{17}$ | 3 2'-, 6'- |
| UV-22 | " | 5-$C_{12}H_{25}$ | 4'-$COCH_3$ | 2 2'- |
| UV-23 | " | 5-$COCH_3$ | 3'-$C_8H_{17}$ | 3 2'-, 6'- |
| UV-24 | " | 5-$OC_{12}H_{25}$ | 4'-$OCH_3C_6H_4$—(p)$CH_3$ | 2 2'- |
| UV-25 | " | 5-$C_8H_{17}$ | 4'-$COC_6H_4$-(p)$CH_3$ | 3 2'-, 6'- |
| UV-26 | —COO— | 4-$C_{12}H_{25}$ | 4'-$C_4H_9$(t) | 1 |
| UV-27 | " | H | 4'-$C_4H_9$(t) | 1 |
| UV-28 | " | 4-$OC_{12}H_{25}$ | 5'-$OCH_3$ | 2 2'- |
| UV-29 | " | 3-$OCH_3$ | 5'-$OC_{12}H_{25}$ | 2 2'- |

At least one of the ultraviolet-absorbing agents for use in the present invention is preferably a liquid at normal temperature.

As the water-insoluble polymer compound to be used in the present invention, specifically, for example, a homopolymer or a copolymer described in U.S. Pat. No. 4,857,449, the seventh column to the 15th column, and in International Publication Patent No. WO 88/00723, pages 12 to 30, can be used. Preferably there is used a water-insoluble polymer compound which comprises at least one homopolymer or copolymer insoluble in water and soluble in organic solvents, which polymer is made up of repeating units having —C(O)—linkages in the main chain or the side chains, particularly made up of repeating units having —C(O)—N—($G_1$)$G_2$ linkages in the side chains wherein $G_1$ and $G_2$ each represent a hydrogen atom, an alkyl group, a cycloalkyl group, or an aryl group, provided that each of $G_1$ and $G_2$ is not a hydrogen atom at the same time, and $G_1$ and $G_2$ may bond together to form a ring. A preferable water-insoluble polymer for the purpose of the present invention is a polymer containing, as monomer units, an alkyl ester of acrylic acid or methacrylic acid, and a copolymer of an alkyl ester of methacrylic acid with styrene is more preferable. In this specification and claims, by "water-insoluble polymer" is meant a polymer whose solubility at 25° C. in water is 1 wt % or below.

Some specific examples of the water-insoluble polymer compound used in the present invention are listed below, but the present invention is not restricted to them. The ratios given in the parenthesis after the polymers are molar ratios.

P-1) Poly(vinyl acetate)
P-2) Poly(vinyl propionate)
P-3) Polymethyl methacrylate
P-4) Polyethyl methacrylate
P-5) Polymethyl acrylate
P-6) Vinyl acetate/vinyl alcohol copolymer (95:5)
P-7) Poly-n-butyl acrylate
P-8) Poly-n-butyl methacrylate
P-9) Polyisobutyl methacrylate
P-10) Polyisopropyl methacrylate
P-11) Polyoctyl acrylate
P-12) n-Butyl acrylate/acrylamide copolymer (95:5)
P-13) Stearyl methacrylate/acrylic acid copolymer (90:10)
P-14) 1,4-Butanediol/adipic acid polyester
P-15) Ethylene glycol/sebacic acid polyester
P-16) Polycaprolactone
P-17) Polypropiolactone
P-18) Polydimethylpropiolactone
P-19) n-Butyl methacrylate/N-vinyl-2-pyrrolidone copolymer (90:10)
P-20) Methyl methacrylate/vinyl chloride copolymer (70:30)
P-21) Methyl methacrylate/styrene copolymer (90:10)
P-22) Methyl methacrylate/ethyl acrylate copolymer (50:50)
P-23) n-Butyl methacrylate/methyl methacrylate/styrene copolymer (50:30:20)
P-24) Vinyl acetate/acrylamide copolymer (85:15)
P-25) Vinyl chloride/vinyl acetate copolymer (65:35)
P-26) Methyl methacrylate/acrylonitrile copolymer (65:35)
P-27) Diacetone acrylamide/methyl methacrylate copolymer (50:50)
P-28) Methyl vinyl ketone/isobutyl methacrylate copolymer (55:45)
P-29) Ethyl methacrylate/n-butyl acrylate copolymer (70:30)
P-30) Diacetone acrylamide/n-butyl acrylate copolymer (60:40)
P-31) Methyl methacrylate/styrene methacrylate/diacetone acrylamide copolymer (40:40:20)
P-32) n-Butyl acrylate/styrene methacrylate/diacetone acrylamide copolymer (70:20:10)

P-33) Stearyl methacrylate/methylmethacrylate/acrylic acid copolymer (50:40:10)
P-34) Methyl methacrylate/styrene/vinylsulfonamide copolymer (70:20:10)
P-35) Methyl methacrylate/phenyl vinyl ketone copolymer (70:30)
P-36) n-Butyl acrylate/methyl methacrylate/n-butyl methacrylate copolymer (35:35:30)
P-37) n-Butyl methacrylate/pentyl methacrylate/N-vinyl-2-pyrrolidone copolymer (38:38:24)
P-38) Methyl methacrylate/n-butyl methacrylate/isobutyl methacrylate/acrylic acid copolymer (37:29:25:9)
P-39) n-Butyl methacrylate/acrylic acid (95:5)
P-40) Methyl methacrylate/acrylic acid copolymer (95:5)
P-41) Benzyl methacrylate/acrylic acid copolymer (90:10)
P-42) n-Butyl methacrylate/methyl methacrylate/benzyl methacrylate/acrylic acid copolymer (35:35:25:5)
P-43) n-Butyl methacrylate/methyl methacrylate/benzyl methacrylate copolymer (35:30:30)
P-44) Polypentyl acrylate
P-45) Cyclohexyl methacrylate/methyl methacrylate/n-propyl methacrylate copolymer (37:29:34)
P-46) Polypentyl methacrylate
P-47) Methyl methacrylate/n-butyl methacrylate copolymer (65:35)
P-48) Vinyl acetate/vinyl propionate polymer (75:25)
P-49) n-Butyl methacrylate/3-acryloxybutane-1-sulfonic acid sodium salt copolymer (97:3)
P-50) n-Butyl methacrylate/methyl methacrylate/acrylamide copolymer (35:35:30)
P-51) n-Butyl methacrylate/methyl methacrylate/vinyl chloride copolymer (37:36:27)
P-52) n-Butyl methacrylate/styrene copolymer (90:10)
P-53) methyl methacrylate/N-vinyl-2-pyrrolidone copolymer (90:10)
P-54) n-Butyl methacrylate/vinyl chloride copolymer (90:10)
P-55) n-Butyl methacrylate/styrene copolymer (70:30)
P-56) Poly(N-sec-butyl acrylamide)
P-57) Poly(N-tert-butyl acrylamide)
P-58) Diacetone acrylamide/methyl methacrylate copolymer (62:38)
P-59) Polycyclohexyl methacrylate
P-60) N-Tert-butyl acrylamide/methyl methacrylate copolymer (30:70)
P-61) Poly(N,N-dibutyl acrylamide)
P-62) Poly(tert-butyl methacrylate)
P-63) Tert-butyl methacrylate/methyl methacrylate copolymer (70:30)
P-64) Poly(N-tert-butyl methacrylamide)
P-65) N-Tert-butyl acrylamide/methylphenyl methacrylate copolymer (60:40)
P-66) Methyl methacrylate/acrylonitrile copolymer (70:30)
P-67) Methyl methacrylate/methyl vinyl ketone copolymer (38:72)
P-68) Methyl methacrylate/styrene copolymer (75:25)
P-69) Methyl methacrylate/hexyl methacrylate (70:30)
P-70) Poly(N-n-butyl methacrylamide)
P-71) Poly(N-iso-butyl acrylamide)
P-72) Poly(N-sec-butyl acrylamide)
P-73) Poly(N-tert-octyl acrylamide)
P-74) Poly(N-phenyl acrylamide)
P-75) poly(N,N-dibutyl acrylamide)
P-76) polycyclohexyl methacrylate In the present invention, the ultraviolet-absorbing agent represented by formula (I) or (II) is preferably used in the upper most non-photosensitive and hydrophilic colloid layer of the photographic constitutional layers. The ultraviolet-absorbing agents are used generally in such a way that they are first dissolved together with a high-boiling organic solvent in a low-boiling organic solvent, such as ethyl acetate, and the solution is mixed with an aqueous gelatin solution containing a surface-active agent and is emulsified and dispersed for use and, in the present invention it is a feature that a water-insoluble polymer compound is further contained simultaneously.

In the present invention, preferably a high-boiling organic solvent that is generally used conventionally is not contained substantially in the solution of ultraviolet-absorbing agent. The expression "is not contained substantially" means that the weight ratio of high-boiling organic solvent is 0.5 or less, preferably 0.2 or less, for the weight of the water-insoluble polymer compound contained in the layer wherein the ultraviolet-absorbing agent is contained. More preferably, no high-boiling organic solvent is contained at all.

Generally, the purpose of using a high-boiling organic solvent is to prevent the surface of the photographic material from becoming rough; otherwise when an emulsified dispersion of an ultraviolet-absorbing agent is applied as a layer of the photographic material, the low-boiling organic solvent is removed by drying and the dissolved ultraviolet-absorbing agent separates as coarse crystals, which makes the surface of the photographic material rough. In the present invention, it is surprising that the surface of the photographic material does not become substantially rough without incorporating a high-boiling organic solvent. The coating amount of the water-insoluble polymer compound is preferably 0.05 $g/m^2$ or more, more preferably 0.1 $g/m^2$ or more, and further more preferably 0.15 $g/m^2$ or more. The upper limit of the coating amount of water-insoluble polymer compound is preferably 2.0 $g/m^2$.

The weight ratio of the ultraviolet-absorbing agents represented by formula (I) or (II), to the water-insoluble polymer compound, is preferably from 0.1 to 5, more preferably from 0.2 to 1. The coating amount of the ultraviolet-absorbing agent represented by formula (I) or (II) is generally 1 to 0.01 $g/m^2$, preferably 0.5 to 0.05 $g/m^2$, more preferably 0.4 to 0.1 $g/m^2$. The average grain size of the emulsified dispersion is 0.3 $\mu$m or less, more preferably 0.1 $\mu$m or less.

The silver halide color photographic material of the present invention has on a support at least one silver halide emulsion layer containing a yellow dye-forming coupler, a silver halide emulsion layer containing a magenta dye-forming coupler, and a silver halide emulsion layer containing a cyan dye-forming coupler, and preferably these emulsion layers are respectively blue-sensitive, green-sensitive, and red-sensitive. The photographic material of the present invention can be constituted by applying these layers in the stated order, but the order may be changed. An infrared-sensitive silver halide emulsion layer can be used in place of at least one of the above photosensitive layers.

In the present invention, to add the above couplers to the photosensitive layers, known various techniques can be used. Generally they can be added by the oil-in-water dispersion method, known as the oil-protect method, wherein the coupler is dissolved in a high-boiling organic solvent and is then emulsified and dispersed in an aqueous gelatin solution containing a surface-active agent. Alternatively the coupler may be formed into an oil-in-water dispersion by adding the coupler solution containing a surface-active agent to water or an aqueous gelatin solution, thereby causing phase inversion. In the case of an alkali-soluble coupler, the coupler can be dispersed by the Fischer dispersion method. Otherwise, the low-boiling organic solvent is removed from a coupler dispersion, for example by distillation, noodle washing, or ultrafiltration, and the remainder may be mixed with the photographic emulsion.

As the dispersion medium for such a coupler, a high-boiling organic solvent having a dielectric constant of 2 to 20 (25° C.) and a refractive index of 1.5 to 1.7 (25° C.), and/or the above-mentioned water-insoluble polymer compound, is preferably used.

As the high-boiling organic solvent that can be used in the present invention, preferably it is a compound that has a melting point of 100° C. or below and a boiling point of 140° C. or over; that is immiscible with water; and that is a good solvent for the ultraviolet-absorbing agent or the coupler. The melting point of the high-boiling organic solvent is preferably 80° C. or below. The boiling point of the high-boiling organic solvent is preferably 160° C. or over, more preferably 170° C. or over.

The high-boiling-point organic solvent can be used in a weight ratio of 0.1 to 10.0, preferably 0.1 to 4.0, to the coupler.

Details of these high-boiling organic solvents are described in JP-A No. 215272/1987, page 137, the right lower column, to page 144, the right upper column.

Water-soluble dyes that can be used are described, for example, in JP-A Nos. 145125/1975, 20830/1977, 147712/1975, 111641/1984, 148448/1986, 151538/1986, 151649/1986, 151650/1986, 151651/1986, 170742/1986, 175638/1986, 235837/1986, 248044/1986, 164043/1987, 253145/1987, 253146/1987, 253142/1987, 275262/1987, and 283336/1987, Research Disclosure RD-17643 (December 1978, page 22), and Research Disclosure RD-18716 (November 1979, page 647); and preferably dyes that can be decolored by processing as in European Patent EP No. 0,337,490A2, pages 27 to 76 (e.g., oxonol dyes).

For example, JP-A 248044/1986 discloses the following compounds which are suitable for use as water soluble dyes in the present invention, which compounds are represented herein by the following Formulae (D-I) to (D-IV):

Formula (D-1)

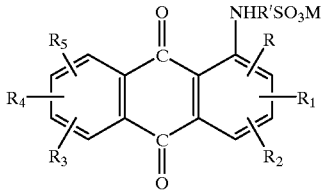

wherein R, $R_1$, $R_3$, $R_4$ and $R_5$ each represent a hydrogen atom, a halogen atom, a hydroxy group, an alkyl group, an alkoxy group, a sulfo group or —NHR'$SO_3$M where R' represents an alkylene group and M represents a cation group.

Formula (D-II)

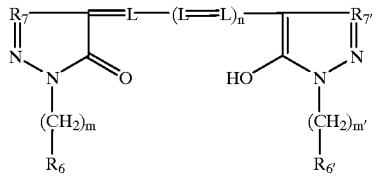

wherein $R_6$ and $R_6$' each represent a hydrogen atom, an alkyl group, an aryl group or a heterocyclic group; $R_7$ and $R_7$' each represent a hydroxy group, an alkoxy group, a cyano group, a trifluoromethyl group, —$COOR_8$, —$CONHR_8$, —$NHCOR_8$, a ureido group, an imino group, an amino group, a substituted amino group substituted by an alkyl group having 1 to 4 carbon atoms or a cyclic amino group represented by

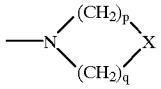

wherein p and q each represent 1 or 2; X represents an oxygen atom, a sulfur atom, or —$CH_2$— group; $R_8$ represents a hydrogen atom, an alkyl group or an aryl group; L represents a methine group; n represents 0, 1 or 2; and m and m' each represent 0 or 1.

Formula (D-III)

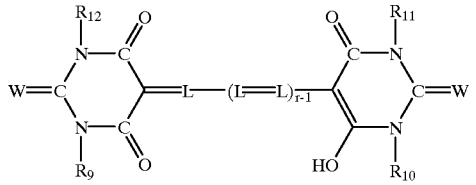

wherein r represents an integer of 1 to 3; W represents an oxygen atom or a sulfur atom; L represents a methine group; $R_9$ to $R_{12}$ each represent a hydrogen atom, an alkyl group, an aryl group, an aralkyl group or a heterocyclic group and at least one of $R_9$ to $R_{12}$ are a substituent other than a hydrogen atom.

Formula (D-IV)

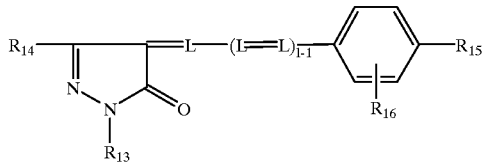

where l represents an integer of 1 or 2; L represents a methine group; $R_{13}$ represents an alkyl group, an aryl group or a heterocyclic group; $R_{14}$ and $R_{15}$ each represent a hydroxy group, an alkyl group, an alkoxy group, a cyano group, a trifluoromethyl group, —$COOR_8$, —$CONHR_8$, —$NHCOR_8$, a ureido group, an imino group, an amino group, a substituted amino group substituted by an alkyl group having 1 to 4 carbon atoms, a cyclic amino group represented by

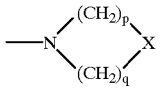

where p and q each represent 1 or 2; X represents an oxygen atom, a sulfur atom or —$CH_2$— group; $R_8$ represents a hydrogen atom, an alkyl group or an aryl group; $R_{16}$ represents a hydrogen atom, an alkyl group, a chlorine atom or an alkoxy group.

The amount of the water-soluble dye is preferably 4 mg/$m^2$ or more but not exceeding 200 mg/$m^2$, particularly preferably 10 mg/$m^2$ or more but not exceeding 100 mg/$m^2$. If several dyes are used, the total amount thereof is preferably in the above range.

As the binding material or protective colloid that can be used in photographic constitutional layers other than the uppermost layer of the photographic material of the present invention, gelatin is advantageously used, but other hydrophilic colloid's can be used alone or in combination with gelatin.

The total coating amount of gelatin in the photographic material is preferably 8.2 g/$m^2$ or less, more preferably 7.8 g/$m^2$ or less, further more preferably 7.4 g/m2 or less, and particularly preferably 7.0 g/$m^2$ or less for the purpose, for example, of enhancing the whiteness of the non-image portion or for rapid processing ability. The lower limit of the total coating amount of gelatin is preferably 3.0 g/$m^2$.

In the present invention, the gelatin may be lime-processed gelatin or acid-processed gelatin. Details of the manufacture of gelatin are described by Arthur Veis in *The Macromolecular Chemistry of Gelatin* (published by Academic Press, 1964).

The gelatin used in the uppermost layer that is a non-photosensitive colloid layer is preferably acid-processed gelatin having an isoelectric point of 6.0 or over, more preferably 6.5 or over, and particularly preferably 7.0 or over. The upper limit of the isoelectric point of gelatin is preferably 10.0.

In the present invention, the dry thickness of the film of photographic constitutional layers of photographic material is preferably 11 $\mu$m or less, more preferably 10 $\mu$m or less, and particularly preferably 8 $\mu$m. The lower limit of the dry thickness of the film of photographic constitutional layers is preferably 3 $\mu$m.

In particular, the thinner the dry film of the uppermost layer is, the more preferable it is, and the dry film thickness of the uppermost layer should be 2 $\mu$m or less, preferably 0.3 to 2.0 $\mu$m. Although the uppermost layer and the silver halide emulsion layer that is located farthest from the support are preferably arranged with them directly in contact with each other, it is possible to provide a hydrophilic colloid layer between the two layers.

The support used in the present invention may be of a transparent-type or a reflective-type and is selected arbitrarily depending on the purpose, but for the purpose of the present invention the use of a reflective-type support is particularly preferred.

The reflective-type support includes a support coated with a hydrophobic resin containing a light-reflective substance, such as titanium oxide, zinc oxide, calcium carbonate, and calcium sulfate, in a dispersed form, and a support made of a hydrophobic resin containing a dispersed-light-reflecting substance. In order to improve the sharpness of images, preferably the photographic material according to the present invention contains, in the hydrophilic resin layer of the support, 12% by weight, more preferably 14% by weight, of titanium oxide whose surface has been treated, for example, with a bivalent to tetravalent alcohol (e.g., trimethylolethane).

Further, in the photographic material according to the present invention, together with the couplers, a color-image-preservability-improving compound, as described in European Patent EP No. 0,277,589A2, is preferably used. That is, a compound (F), which will chemically bond to the aromatic amine developing agent remaining after the color development process, to form a chemically inactive and substantially colorless compound, and/or a compound (G), which will chemically bond to the oxidized product of the aromatic amine color developing agent remaining after color development process, to form a chemically inactive and substantially colorless compound, are preferably used alone or in combination, for example, to prevent the occurrence of stain due to a color-developed dye by the reaction of the couplers with the color developing agent or its oxidized product remaining in the film during the storage after the processing, as well as to prevent other side effects.

Further, preferably, to the photographic material according to the present invention, a mildew-proofing agent, as described in JP-A No. 271247/1988, is added preferably in order to prevent the propagation of mildew and fungi in the hydrophilic colloid layers, which propagation will deteriorate an image.

The photographic material according to the present invention may be exposed to visible light or infrared light.

As the method of exposure, low-illumination-intensity exposure or high-illumination-intensity exposure may be used, and a laser scanning exposure system, wherein the exposure time is $10^{-4}$ or less per picture element, is preferable.

In the exposure, preferably a band stop filter, described in U.S. Pat. No. 4,880,726, is used, and thereby light color mixing is prevented and the color reproduction is improved remarkably.

As components (couplers and additives) and photographic constitutional layers (including arrangement of layers and the like) that will be applied to the present invention, and as the processing method and processing additives that will be applied for processing the photographic material of the present invention, those described in the below-mentioned patent gazettes, particularly in European Patent EP No. 0,355,660A2, are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiiing and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right coluinn lines 1 to 15 | p. 45 lines 41 to 52 |
| Dye | p. 156 lower right column line 15 to p. 184 lower | p. 38 upper left column line 12 to upper right column | p. 66 lines 18 to 22 |

-continued

| Element constituting photographic material | JP-A No. 215272/1987 | JP-A No. 33144/1990 | EP 0,355,660A2 |
|---|---|---|---|
| | right column last line | line 7 | |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column in last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 21572/1987, amendment filed on March 16, 1987 is included. Further, among the above-mentioned couplers, it is preferred to use so called short wavelength-type yellow coupler, described in JP-A Nos. 231451/1988, 123047/1988, 241547/1988, 173499/198.9, and 250944/1989, as a yellow coupler. Further, microalkane-type acetoanilido series yellow couplers described in JP-A No. 116643/1992 and indolinocarbonyl anilide series yellow couplers described in EP 0,482,552 are preferably used.

As the method for processing a silver halide color photographic material, which uses a high-silver chloride emulsion whose silver chloride content is 90 mol % or more, with a color developer substantially free from any sulfite, a method described in JP-A No. 207250/1990, page 27, the left upper column, to page 34, the right upper column, is preferably used. Herein the expression "substantially free from any sulfite" means that the amount of a sulfite is 0.2 g/liter or less in terms of sodium sulfite. If a sulfite as an agent is weighed and added in an amount of about 0.2 g/liter, when the solution is prepared it reacts with the oxygen in the air and most of it is consumed; thereby it is unharmful photographically and does not affect the decoloring speed of dyes.

According to the present invention, a color photograph can be obtained wherein the whiteness of the non-image portion is high and the glossiness of the surface after the passing of time following the processing is not deteriorated.

This effect is particularly noticeable when rapid processing with a color developer substantially free from any sulfite is carried out.

The present invention will be described in detail in accordance with examples, but the invention is not limited to these examples.

EXAMPLE 1

After the surface of a paper support, whose both surfaces were laminated with polyethylene, was subjected to corona discharge treatment, a gelatin undercoat layer containing sodium dodecylbenzenesulfonate was provided thereon, and various photographic constitutional layers were applied, to prepare a multi-layer color photographic printing paper (Sample 101) having the below-given layer constitution. The polyethylene layer of the paper support on the side wherein emulsions were applied contained 15% by weight of titanium oxide and had a thickness of 30 $\mu$m. The coating solution were prepared as follows:

Preparation of a First Layer Coating Solution

270 Mililiters of ethyl acetate, 37.4 ml of Solvent (Solv-3), and 37.4 ml of Solvent (Solv-6) were added to 153.0 g of Yellow Coupler (ExY), 47.8 g of Image-dye Stabilizer (Cpd-1), 12.8 g of Image-dye Stabilizer (Cpd-9), and 3.2 g of Image-dye Stabilizer (Cpd-12), to dissolve them, and the solution was emulsified and dispersed in a 10% aqueous gelatin solution containing 60 ml of 10% sodium dodecylbenzenesulfonate and 10 g of citric acid, to prepare Emulsified Dispersion A. Separately, Silver Chlorobromide Emulsion B (comprising cubic silver halide grains made up of a mixture of a large size emulsion having an average grain size of 0.88 $\mu$m and a small size emulsion having an average grain size of 0.70 $\mu$m in a molar ratio of 6:4 in terms of silver, wherein the deviation coefficients of the grain size distributions are 0.08 and 0.10 respectively; each of the emulsions has 0.3 mol % of silver bromide being localized on the surface of the grains; and the remaining part of grain is made of silver chloride) was prepared.

The above Emulsified Dispersion A and the Silver Chlorobromide Emulsion B were mixed and dissolved, to prepared a first layer coating solution having the following composition.

Coating solutions for second to seventh layers were prepared in the same manner as above. As the gelatin hardener of each layer, H-1 and H-2 were used.

Cpd-10 and Cpd-11 were added to each layer so that the total amounts thereof might be 25.0 mg/m$^2$ and 50.0 mg/m$^2$, respectively.

In the silver chlorobromide emulsions of photosensitive emulsion layers, the following spectral sensitizing dyes were used.

Blue-sensitive emulsion layer:

Sensitizing dye A

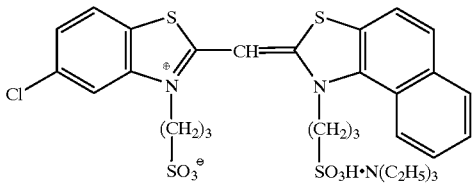

and

Sensitizing dye B

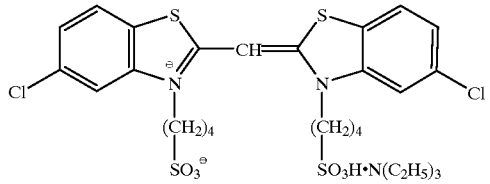

(each 2.0×10$^{-4}$ mol to the large size emulsion and 2.5×10$^{-4}$ mol to the small size emulsion, per mol of silver halide.)

Green-sensitive emulsion layer:

Sensitizing dye C

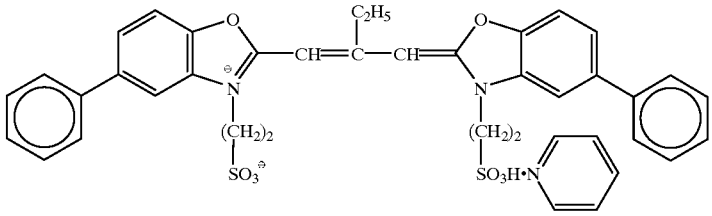

(4.0×10$^{-4}$ mol to the large size emulsion and 5.6×10$^{-4}$ mol to the small size emulsion, per mol of silver halide)

and

Sensitizing dye D

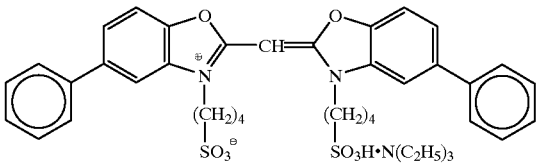

(7.0×10$^{-5}$ mol to the large size emulsion and 1.0×10$^{-5}$ mol to the small size emulsion, per mol of silver halide)

Red-sensitive emulsion layer:

Sensitizing dye E

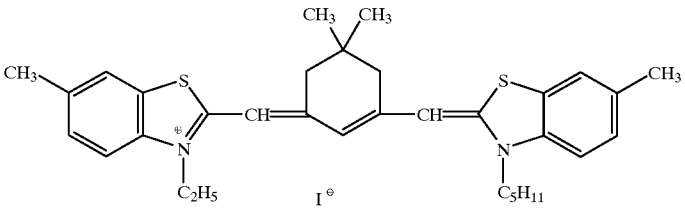

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

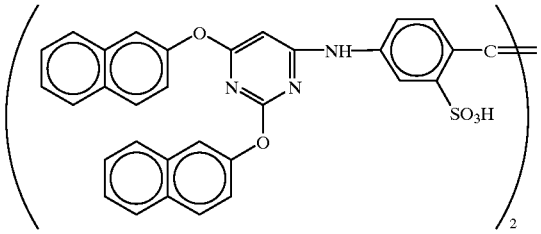

Further, respectively to the blue-sensitive emulsion layer, the green-sensitive emulsion layer, and the red-sensitive emulsion layer, was added 1-(5-methylureidophenyl)-5-mercaptotetrazole in respective amounts of $8.5\times10^{-5}$ mol, $7.7\times10^{-4}$ mol, and $2.5\times10^{-4}$ mol, per mol of the silver halide.

Further, respectively to the blue-sensitive emulsion layer and the green-sensitive emulsion layer, was added 4-hydroxy-6-methyl-1,3,3a,7-tetrazaindene in respective amounts of $1\times10^{-4}$ mol and $2\times10^{-4}$ mol, per mol of the silver halide.

Further, to prevent irradiation, the following dye (the coating amount is indicated in parentheses) was added to the emulsion layers.

(Layer Constitution)

The layer constitution of each layer is shown below. The numerals indicate coating amounts (g/m$^2$). The coating amount of each of the silver halide emulsions is in terms of silver.

| | |
|---|---|
| Support<br>Paper laminated on both sides with polyethylene (a white pigment, $TiO_2$, and a bluish dye, ultramarine, were included in the first layer side of the polyethylene-laminated film) | |
| First Layer (Blue-sensitive emulsion layer) | |
| Silver chlorobromide emulsion (comprising cubic silver halide grains made up of a mixture of a large size emulsion having an average grain size of 0.88 $\mu$m and a small size emulsion having an average grain size of 0.70 $\mu$m in a molar ratio of 6:4 in terms of silver, wherein the deviation coefficients of the grain size distributions are 0.08 and 0.10 respectively; each of the emulsions has 0.3 mol % of silver bromide being localized on the surface of the grains; and the remaining part of grain is made of silver chloride) | 0.26 |
| Gelatin | 1.52 |
| Yellow coupler (ExY) | 0.48 |
| Solvent (Solv-3) | 0.18 |
| Solvent (Solv-6) | 0.18 |

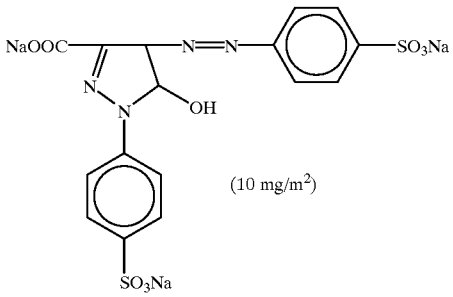

(10 mg/m$^2$)

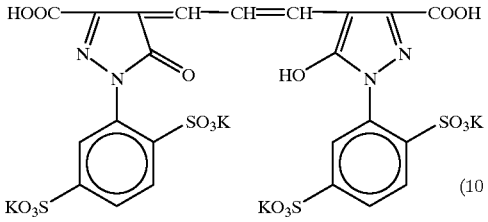

(10 mg/m$^2$)

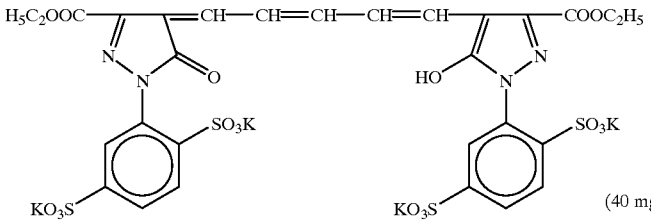

(40 mg/m$^2$)

and

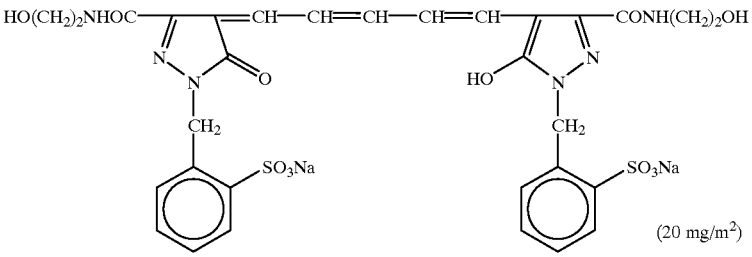

(20 mg/m$^2$)

-continued

| Support<br>Paper laminated on both sides with polyethylene (a white pigment, $TiO_2$, and a bluish dye, ultramarine, were included in the first layer side of the polyethylene-laminated film) | |
|---|---|
| Image-dye stabilizer (Cpd-1) | 0.15 |
| Image-dye stabilizer (Cpd-9) | 0.04 |
| Stabilizer (Cpd-12) | 0.01 |
| Second Layer (Color-mix preventing layer) | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer) | |
| Silver chlorobromide emulsion (comprising cubic silver halide grains made up of a mixture of a large size emulsion having an average grain size of 0.55 $\mu$m and a small size emulsion having an average grain size of 0.39 $\mu$m in a molar ratio of 1:3 in terms of silver, wherein the deviation coefficients of the grain size distributions are 0.10 and 0.08 respectively; each of the emulsions has 0.8 mol % of silver bromide being localized on the surface of the grains; and the remaining part of grain is made of silver chloride) | 0.12 |
| Gelatin | 1.24 |
| Magenta coupler (ExM) | 0.16 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.80 |
| Fourth layer (Ultraviolet-absorbing layer) | |
| Gelatin | 1.58 |
| Ultraviolet-absorbing agent (UV-1) | 0.47 |

-continued

| Support<br>Paper laminated on both sides with polyethylene (a white pigment, $TiO_2$, and a bluish dye, ultramarine, were included in the first layer side of the polyethylene-laminated film) | |
|---|---|
| Color-mix inhibitor (Cpd-5) | 0.05 |
| Solvent (Solv-5) | 0.24 |
| Fifth Layer (Red-sensitive emulsion layer) | |
| Silver chlorobromide emulsion (comprising cubic silver halide grains made up of a mixture of a large size emulsion having an average grain size of 0.58 $\mu$m and a small size emulsion having an average grain size of 0.45 $\mu$m in a molar ratio of 1:4 in terms of silver, wherein the deviation coefficients of the grain size distributions are 0.09 and 0.11 respectively; each of the emulsions has 0.6 mol % of silver bromide being localized on the surface of the grains; and the remaining part of grain is made of silver chloride) | 0.20 |
| Gelatin | 0.80 |
| Cyan coupler (ExC) | 0.25 |
| Image-dye stabilizer (Cpd-2) | 0.01 |
| Image-dye stabilizer (Cpd-4) | 0.01 |
| Image-dye stabilizer (Cpd-6) | 0.08 |
| Image-dye stabilizer (Cpd-7) | 0.18 |
| Image-dye stabilizer (Cpd-8) | 0.02 |
| Solvent (Solv-4) | 0.14 |
| Sixth layer (Ultraviolet-absorbing layer) | |
| Gelatin | 1.06 |
| Ultraviolet-absorbing agent (UV-1) | 0.32 |
| Image-dye stabilizer (Cpd-3) | 0.04 |
| Solvent (Solv-5) | 0.32 |
| Seventh layer (Protective layer) | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

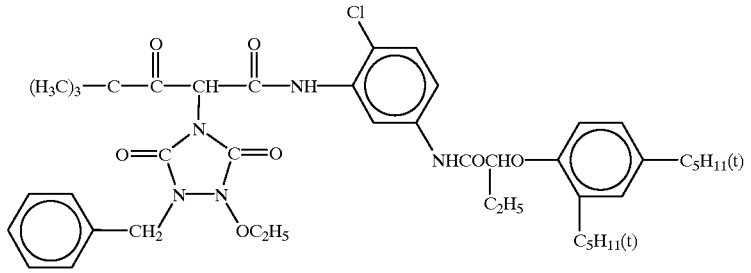

and

-continued
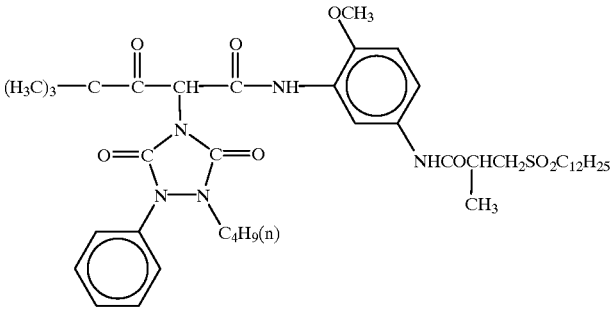
(ExM) Magenta coupler
Mixture (1:1 in molar ratio) of
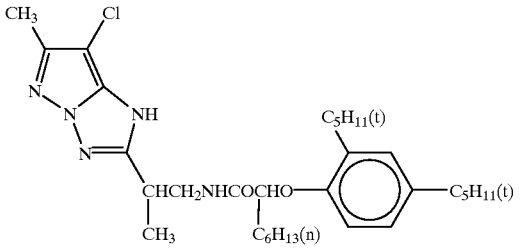
and
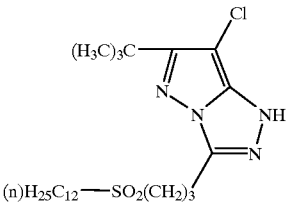
(ExC) Cyan coupler
Mixture (1:1 in molar ratio) of
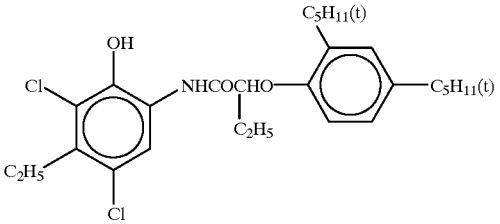
and
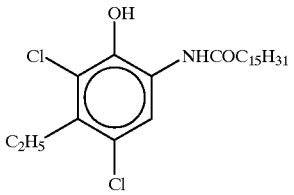
(Cpd-1) Image-dye stabilizer
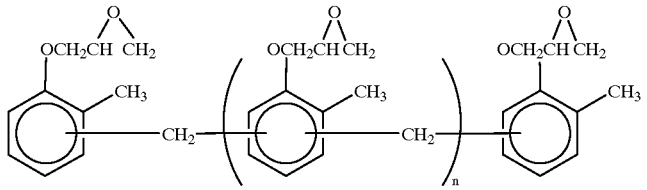
average of n = 7–8
(Cpd-2) Image-dye stabilizer
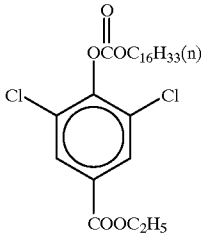

-continued
(Cpd-3) Image-dye stabilizer
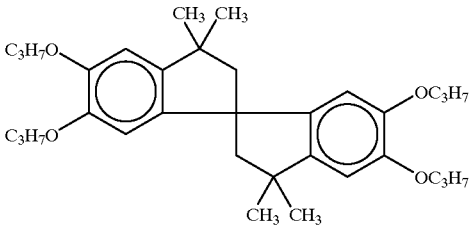
(Cpd-4) Image-dye stabilizer
Mixture (1:1 in molar ratio) of
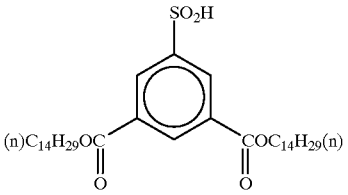
and
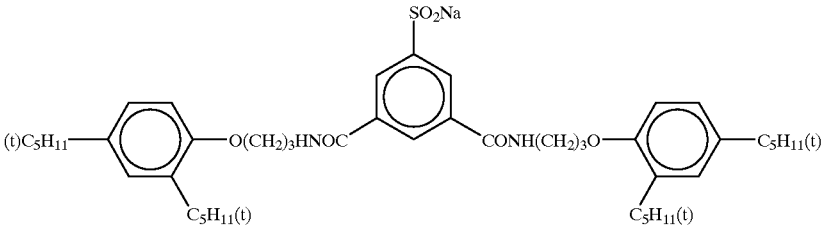
(Cpd-5) Color-mix inhibitor
Mixture (1:1 in weight ratio) of
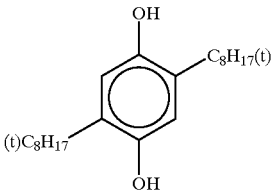
and
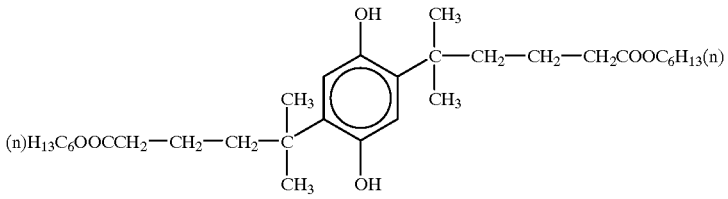
(Cpd-6) Image-dye stabilizer
Mixture ((i):(ii):(iii) = 2:4:4 in weight ratio) of
(i)
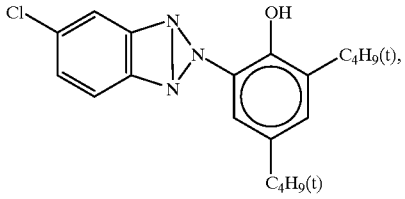

-continued
(ii)
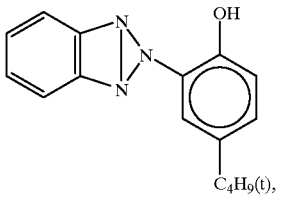
and
(iii)
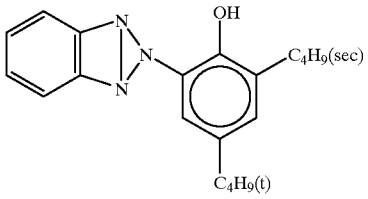
(Cpd-7) Image-dye stabilizer
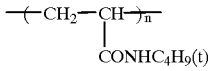
Average molecular weight: 60,000
(Cpd-8) Image-dye stabilizer
Mixture (1:1 in weight ratio) of
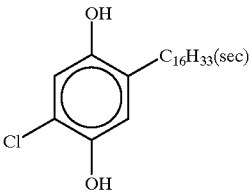
and
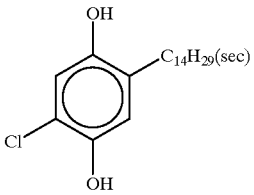
(Cpd-9) Image-dye stabilizer
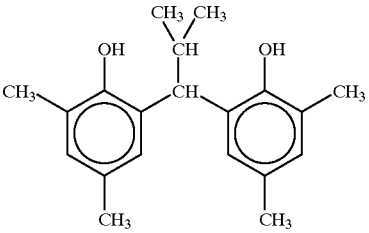
(Cpd-10) Antiseptic
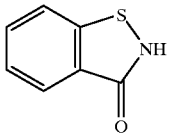
(Cpd-11) Antiseptic
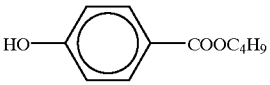
(Cpd-12) Stabilizer
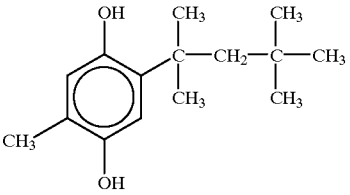

-continued
(Cpd-13) Polymer compound
Above described Exemplified Compound P-68
(average molecular weight: ca. 60,000, and molar ratio of comonomers: 50:50
(UV-1) Ultraviolet-absorbing agent
Mixture ((iv):(v):(vi):(vii) = 5:2:1:2 in weight ratio) of
(iv)
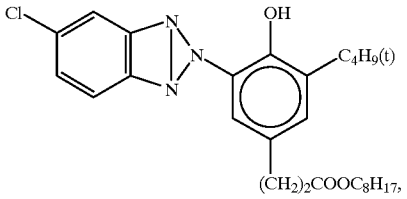
(v)
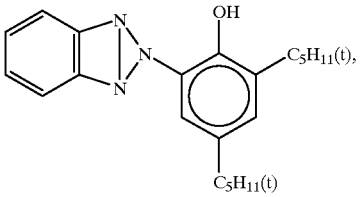
(vi)
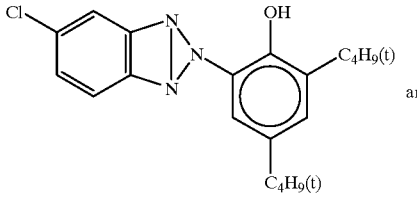
and
(vii)
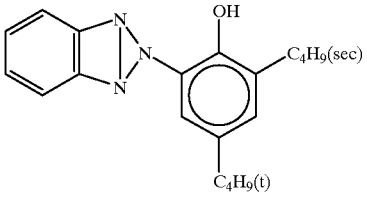
(H-1)
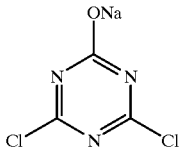
(H-2)
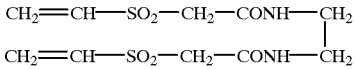
(Solv-1) Solvent
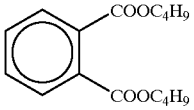

-continued (Solv-2) Solvent

Mixture (1:1 in weight ratio) of

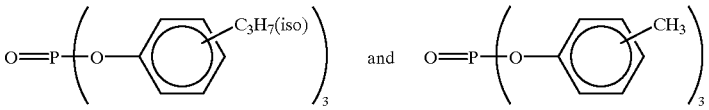

(Solv-3) Solvent $O{=}P{-}(O{-}C_9H_{19}(iso))_3$ (Solv-4) Solvent

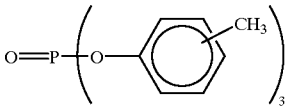

(Solv-5) Solvent $COOC_8H_{17}$
|
$(CH_2)_8$
|
$COOC_8H_{17}$ (Solv-6) Solvent $C_8H_{17}CHCH(CH_2)_7COOC_8H_{17}$
\ /
O The gelatin used in the sixth layer had an isoelectric point of 5.0. The gelatin used in the seventh layer had an isoelectric point of 6.9.

Sample 102 was the same as Sample 101, but excluding the seventh layer; Sample 103 was the same as Sample 102, except that the gelatin used in the sixth layer was replaced with the same amount of a gelatin having an isoelectric point of 6.9; and Sample 104 was the same as Sample 103, except that Solv-5, which was emulsified and dispersed simultaneously with the ultraviolet-absorbing agent UV-1, was replaced with the same weight of Cpd-13. Sample 105 was the same as Sample 104, except that Cpd-13 was replaced with the same weight of Cpd-7.

An emulsified dispersion of Sample 105 was prepared by emulsifying and dispersing a solution containing 40 g of Cpd-7 and 40 g of UV-1 in 160 ml of ethyl acetate into an aqueous gelatin solution containing 60 ml of 10% sodium dodecylbenzenesulfonate and having an isoelectric point of 6.9.

The average grain size of the emulsified dispersion of the ultraviolet-absorbing agent in Samples 101 to 105 was 0.07 μm in each case.

The thus obtained Sample 101 was exposed to light using a standard object, and Sample 101 was continuously processed using an automatic processor for paper in the below-described processing steps using solutions having the below-described compositions, until the replenishing amount reached twice the volume of the color-developing tank (Standard Processing Condition A). An automatic processor for paper, by which the same processing as above was carried out with the temperature of the rinse step being 15° C. and the replenishing amount being 180 ml (½ of the above), was prepared. The processing conditions of the latter automatic processor were the simulated processing conditions that would occur in the actual continuous processing (Processing Condition B).

Standard Processing Condition A

| Processing Step | Temperature (° C.) | Time (sec) | Replenisher* (ml) | Tank Volume (liter) |
|---|---|---|---|---|
| Color developing | 35 | 45 | 161 | 17 |
| Bleach-fixing | 35 | 45 | 215 | 17 |
| Rinse (1) | 35 | 20 | — | 10 |
| Rinse (2) | 35 | 20 | — | 10 |
| Rinse (3) | 35 | 20 | 360 | 10 |
| Drying | 80 | 60 | | |

Note: *Replenisher amount per $m^2$ of photographic material. Rinsing steps were carried out in 3-tanks countercurrent mode from the tank of rinse (3) to the tank of rinse (2) and from the tank of rinse (2) to the tank of rinse (1).

The composition of each processing solution is as followed, respectively:

| Color-developer | Tank Solution | Replenisher |
|---|---|---|
| Water | 700 ml | 700 ml |
| Ethylenediaminetetraacetic acid | 3.0 g | 3.0 g |
| Disodium 1,2-dihydroxybenzene-4,6-disulphate | 0.5 g | 0.5 g |
| Potassium bromide | 0.01 g | — |
| Sodium chloride | 1.6 g | — |
| Potassium carbonate | 27 g | 27 g |
| N-ethyl-N-(β-methanesulfonamidoethyl)-3-methyl-4-aminoaniline sulfate | 5.0 g | 7.1 g |
| Dinsodium N,N-di(sulfoethyl)-hydroxylamine | 8.0 g | 10.0 g |
| Sodium sulfite | 0.1 g | 0.2 g |
| Fluorescent whitening agent (WHITEX-4B, made by Sumitomo Chemical Ind.) | 1.0 g | 2.5 g |
| Water to make | 1000 ml | 1000 ml |
| pH (25° C.) | 10.05 | 10.45 |

Bleach-fixing solution

-continued

| (Both tank solution and replenisher) | |
|---|---|
| Water | 600 ml |
| Ammonium thiosulfate (700 g/l) | 100 ml |
| Iron (III) ammonium ethylenediamine-tetraacetate | 55 g |
| Disodium ethylenediaminetetraacetate | 5 g |
| Ammonium bromide | 40 g |
| Nitric acid (67%) | 30 g |
| Water to make | 1000 ml |
| pH (25° C.) (adjusted by nitric acid and aqueous ammonia) | 5.8 |

Rinse solution (Both tank solution and replenisher)

Ion-exchanged water (calcium and magnesium each are 3 ppm or below)

The sample was subjected to gradation exposure of a color separation filter for sensitometry using an FWH-type sensitometer, manufactured by Fuji Photo Film Co., Ltd. (the color temperature of the light source: 3200K). The thus exposed sample was processed by the automatic processor for paper (Processing Conductions A and B), which had been in the running state.

The reflection density of the processed sample was measured by a TCD-type density-measuring apparatus, manufactured by Fuji Photo Film Co., Ltd., to find the density of stain in the white background (unexposed portion). The gloss of the processed sample was judged visually and was divided into three stages: good (○), somewhat poor (Δ), and poor (X), the gloss of Sample 101 at immediately after the processing being the level of good (○). The processed sample after the visual evaluation was kept at a temperature of 80° C. and a humidity of 80% for 7 days, and then the gloss of the surface was visually judged again.

The obtained results are shown in Table 1.

TABLE 1

| Sample | Density of white background: Processing condition A | | | Density of white background: Processing condition B | | | Surface gloss*: Immediately after processing | Surface gloss*: After storage for 7 days at 80° C., 80% RH | Remarks |
|---|---|---|---|---|---|---|---|---|---|
| No. | Y | M | C | Y | M | C | | | |
| 101 | 0.11 | 0.08 | 0.10 | 0.13 | 0.08 | 0.15 | ○ | ○ | Comparison |
| 102 | 0.11 | 0.08 | 0.10 | 0.11 | 0.08 | 0.10 | x | x | Comparison |
| 103 | 0.11 | 0.08 | 0.10 | 0.11 | 0.08 | 0.10 | ○ | x | Comparison |
| 104 | 0.11 | 0.08 | 0.10 | 0.11 | 0.08 | 0.10 | ○ | ○ | Invention |
| 105 | 0.11 | 0.08 | 0.10 | 0.11 | 0.08 | 0.10 | ○ | ○ | Invention |

Note:
*Evaluation of surface gloss: The gloss of Sample 101 at immediately after the processing is ○.
○: Good
Δ: Somewhat poor
x: Poor As is apparent from the results in Table 1, it can be understood that Samples 104 and 105 of the present invention are good in the gloss of the surface immediately after the processing and also after storage. Further, the density of the white background of Samples 104 and 105 is favorably low.

In Sample 101, the increase of the stain density of the white background is unfavorably great in Processing Condition B. Sample 102 is unfavorably poor in the gloss of the surface. In Samples 102 and 103, oily stickiness of the print surface after storage occurred. Although Sample 103 is improved in gloss of the surface immediately after the processing, since the isoelectric point of the gelatin in the uppermost layer is 6.0 or over, however the gloss after storage is not improved. In contrast, in the case of Samples 104 and 105, wherein an ultraviolet-absorbing agent is emulsified together with a water-insoluble polymer, it is understood that the surface gloss is improved not only immediately after the processing but also after storage. Further, the occurrence of oily stickiness on the surface of the color photographs was not observed.

EXAMPLE 2

Samples 101 and 104 were processed in the same manner as in Example 1 under Processing Condition B, except that sodium sulfite was added in an amount of 2 g/liter to the color developer. As is apparent from the results of Example 1, Sample 101 is inferior to Sample 104 of the present invention only in the white background density under Processing Condition B.

With respect to samples processed before the addition of sodium sulfite and samples processed after the addition of sodium sulfite, the maximum density of the exposed part and the minimum density (white background density) of the non-image portion were measured, and the results are shown in Table 2.

TABLE 2

| Sample No. | Sodium sulfite | Maximum density Y | Maximum density M | Maximum density C | Density of white background Y | Density of white background M | Density of white background C | Remarks |
|---|---|---|---|---|---|---|---|---|
| 101 | not added | 2.30 | 2.28 | 2.35 | 0.13 | 0.08 | 0.15 | Comparison |
| 101 | added | 2.03 | 2.15 | 2.21 | 0.11 | 0.08 | 0.10 | Comparison |
| 104 | not added | 2.30 | 2.28 | 2.35 | 0.11 | 0.08 | 0.10 | Invention |
| 104 | added | 2.05 | 2.15 | 2.20 | 0.11 | 0.08 | 0.10 | Comparison |

As is apparent from the results in Table 2, the addition of sodium sulfite lowers the white background density of Sample 101, to bring it to the same level as that of Sample 104 of the present invention, and at the same time the addition of sodium sulfite lowers conspicuously the maximum density, which is not a preferable processing condition. It can be understood that Sample 104 of the present invention is preferably low in the white background density in the absence of a sulfite.

EXAMPLE 3

The same procedure for Coated Sample 103 prepared in Example 1 was repeated, except that the mixing ratio of the ultraviolet-absorbing agent and the ratio of Cpd-13 or Cpd-7 to Solv-5 were changed as shown in Table 3, thereby preparing Samples 301 to 311.

These samples were developed under Processing Condition B used in Example 1.

The ultraviolet-absorbing agent (iv) in Table 3 was a liquid at normal temperature. Other ultraviolet-absorbing agents (v) to (vii) were solid at normal temperature.

The processed samples were kept at a temperature of 80° C. and a humidity of 90% for two weeks, and the gloss of the surface and the presence of oily stickiness of the surface were evaluated. The gloss of surface was evaluated in the same manner as in Example 1. The oily stickiness was evaluated by a finger test to check if a oily substance adhered on the finger exist or not.

The results are shown in Table 4.

TABLE 3

| Sample No. | Water-insoluble polymer Cpd-7 | Water-insoluble polymer Cpd-13 | High-boiling organic solvent Solv-5 | Ultraviolet-absorbing agent (iv) | Ultraviolet-absorbing agent (v) | Ultraviolet-absorbing agent (vi) | Ultraviolet-absorbing agent (vii) | Remarks |
|---|---|---|---|---|---|---|---|---|
| 301 | — | — | 0.32 | 0.16 | 0.064 | 0.032 | 0.064 | Comparison |
| 302 | — | — | " | 0.064 | 0.102 | 0.051 | 0.103 | " |
| 303 | — | — | " | 0.032 | 0.115 | 0.058 | 0.115 | " |
| 304 | — | — | " | — | 0.128 | 0.064 | 0.128 | " |
| 305 | 0.16 | 0.16 | — | 0.16 | 0.064 | 0.032 | 0.064 | Invention |
| 306 | " | " | — | 0.064 | 0.102 | 0.051 | 0.103 | " |
| 307 | " | " | — | 0.032 | 0.115 | 0.058 | 0.115 | " |
| 308 | " | " | — | — | 0.128 | 0.064 | 0.128 | " |
| 309 | 0.145 | 0.145 | 0.03 | 0.16 | 0.064 | 0.032 | 0.064 | " |
| 310 | 0.13 | 0.13 | 0.06 | " | " | " | " | " |
| 311 | 0.10 | 0.10 | 0.12 | " | " | " | " | " |

TABLE 4

| Sample No. | Surface gloss after storage for 2 weeks at 80° C., 90% RH | Oily stickiness on the surface | Remarks |
|---|---|---|---|
| 301 | x | Exist | Comparison |
| 302 | x | Exist | " |
| 303 | x | Exist | " |
| 304 | x | Exist | " |
| 305 | ○ | Not exist | Invention |
| 306 | ○ | Not exist | " |
| 307 | ○ | Not exist | " |
| 308 | Δ | Not exist | " |
| 309 | ○ | N0t exist | " |
| 310 | ○ | Not exist | " |
| 311 | ○ | Exist slightly | " |

As is apparent from the results in Table 3, Samples 301 to 304, which do not contain the water-insoluble polymer Cpd-13 or Cpd-7, are poor in gloss of the surface, and oily stickiness was observed in them. Samples 305 to 311 of the present invention, which contain a water-insoluble polymer, do not have such defects or have less such defects and therefore are preferable. It can be understood that, out of the samples of the present invention, those free from any high-boiling organic solvent or substantially free from any high-boiling organic solvent, or those containing an ultraviolet-absorbing agent that is a liquid at normal temperature, are particularly preferable (Samples 305 to 310).

Having described our invention as related to the present embodiments, it is our intention that the invention not be limited by any of the details of the description, unless otherwise specified, but rather be construed broadly within its spirit and scope as set out in the accompanying claims.

What we claim is:

1. A multiple layer silver halide color photographic material comprising, on a reflective support, a plurality of silver halide emulsion layers, at least one silver halide emulsion layer containing a cyan dye-forming coupler, at least one silver halide emulsion layer containing a magenta dye-forming coupler, and at least one silver halide emulsion layer containing a yellow dye-forming coupler, wherein the silver chloride content of the silver halide emulsion contained in at least one of the emulsion layers is at least 90 mol %; and a plurality of non-photosensitive colloid layers wherein at least one contains an ultraviolet-absorbing agent; wherein said material contains a water-soluble dye, and wherein said silver halide color photographic material comprises, in the non-photosensitive colloid layer furthest from the support containing an ultraviolet-absorbing agent, a dispersion of an emulsified and dispersed mixture of a solution of at least one ultraviolet-absorbing agent represented by formulae (I) or (II), and at least one water-insoluble polymer compound, and a gelatin having an isoelectric point of at least 6.0:

(I)

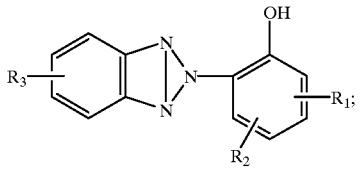

(II)

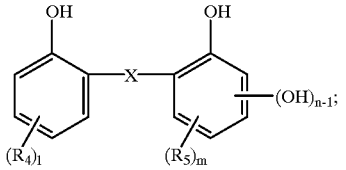

wherein $R_1$, $R_2$ and $R_3$ each represent a hydrogen atom, a halogen atom, a nitro group, a hydroxyl group, an alkyl group, an alkoxy group, an aryl group, an aryloxy group, or an acylamino group, and $R_4$ and $R_5$ each represent a hydrogen atom, an alkyl group, an alkoxy group, or an acyl group, wherein the $R_1$, $R_2$, $R_3$, $R_4$ and $R_5$ groups may be substituted, X represents —CO— or —COO—, and l, m and n are each an integer of 1 to 4.

2. The silver halide color photographic material as claimed in claim 1, wherein the coating amount of ultraviolet-absorbing agent represented by formula (I) or (II) is 1 to 0.01 g/m$^2$.

3. The silver halide color photographic material as claimed in claim 1, wherein at least one of ultraviolet-absorbing agents represented by formula (I) or (II) is a liquid at normal temperature.

4. The silver halide color photographic material as claimed in claim 1, wherein the uppermost non-photosensitive colloid layer containing at least one ultraviolet-absorbing agent represented by formula (I) or (II) and at least one water-insoluble polymer compound is substantially free from high-boiling organic solvent.

5. The silver halide color photographic material as claimed in claim 1, wherein the coating amount of water-insoluble compound is 0.005 g/m$^2$ or more.

6. The silver halide color photographic material as claimed in claim 1, wherein the weight ratio of ultraviolet-absorbing agent represented by formula (I) or (II) to water-insoluble compound is 0.1 to 5.

7. The silver halide color photographic material as claimed in claim 1, wherein the amount of water-soluble dye to be used is 4 to 200 mg/m$^2$.

8. The silver halide color photographic material as claimed in claim 1, wherein the total coating amount of gelatin in said color photographic material is 8.2 g/m$^2$ or less.

9. The silver halide color photographic material as claimed in claim 1, wherein the dry thickness of photographic constitutional layers of said color photographic material is 11 $\mu$m or less.

10. The silver halide color photographic material as claimed in claim 1, wherein the dry thickness of said uppermost non-photosensitive colloid layer is 2 $\mu$m or less.

11. The silver halide color photographic material as claimed in claim 1, wherein the water-insoluble polymer compound is a homopolymer or a copolymer insoluble in water and soluble in organic solvents, which polymer comprises repeating units having —C(O)— linkages in the main chain or the side chains.

12. The silver halide color photographic material as claimed in claim 11, wherein the water-insoluble polymer compound is a polymer which comprises repeating units having —C(O)—N—($G_1$)$G_2$ linkages in the side chains wherein $G_1$ and $G_2$ each represent a hydrogen atom, an alkyl group, a cycloalkyl group, or an aryl group, provided that each of $G_1$ and $G_2$ is not a hydrogen atom at the same time, and $G_1$ and $G_2$ may bond together to form a ring.

13. The silver halide color photographic material as claimed in claim 11, wherein the water-insoluble polymer compound is a polymer containing, as monomer units, an alkyl ester of acrylic acid or methacrylic acid.

14. The silver halide color photographic material as claimed in claim 13, wherein the water-insoluble polymer compound is a copolymer of an alkyl ester of methacrylic acid with styrene.

15. The silver halide color photographic material as claimed in claim 1, wherein the isoelectric point of gelatin is 6.0 to 10.0.

16. The silver halide color photographic material as claimed in claim 1, wherein the isoelectric point of gelatin is 6.5 or over.

17. The silver halide color photographic material as claimed in claim 16, wherein the isoelectric point of gelatin is 7.0 or over.

18. The silver halide color photographic material as claimed in claim 5, wherein the coating amount of water-insoluble compound is 0.005 to 2.0 g/m$^2$.

19. The silver halide color photographic material as claimed in claim 8, wherein the total coating amount of gelatin is 3.0 to 8.2 g/m$^2$.

20. The silver halide color photographic material as claimed in claim 9, wherein the dry thickness of photographic constitutional layers is 3 to 11 $\mu$m.

21. The silver halide color photographic material as claimed in claim 10, wherein the dry thickness of the uppermost non-photosensitive colloid layer is 0.3 to 2 $\mu$m.

* * * * *